US009051799B2

(12) United States Patent
Coleman et al.

(10) Patent No.: US 9,051,799 B2
(45) Date of Patent: Jun. 9, 2015

(54) PRELOAD AND CENTRALIZING DEVICE FOR MILLING SUBTERRANEAN BARRIER VALVES

(75) Inventors: David W. Coleman, Broussard, LA (US); Benny J. Vincent, Tiki Island, TX (US)

(73) Assignee: Baker Hughes Incorporated, Houston, TX (US)

( * ) Notice: Subject to any disclaimer, the term of this patent is extended or adjusted under 35 U.S.C. 154(b) by 258 days.

(21) Appl. No.: 13/605,166

(22) Filed: Sep. 6, 2012

(65) Prior Publication Data

US 2014/0060801 A1 Mar. 6, 2014

(51) Int. Cl.

| | |
|---|---|
| ***E21B 29/00*** | (2006.01) |
| ***E21B 17/14*** | (2006.01) |
| ***E21B 10/26*** | (2006.01) |
| ***E21B 4/18*** | (2006.01) |

(52) U.S. Cl.

CPC ..... *E21B 29/002* (2013.01); *E21B 17/14* (2013.01); *E21B 29/00* (2013.01); *E21B 4/18* (2013.01)

(58) Field of Classification Search

CPC ..... E21B 29/02; E21B 17/14; E21B 10/26
USPC ..... 166/298, 55.1, 376, 242.7, 241.6, 317, 166/55.2, 170, 174, 75
See application file for complete search history.

(56) References Cited

U.S. PATENT DOCUMENTS

| | | | | |
|---|---|---|---|---|
| 3,870,112 | A * | 3/1975 | Castel et al. | 175/93 |
| 5,407,011 | A * | 4/1995 | Layton | 166/376 |
| 5,522,461 | A * | 6/1996 | Carter et al. | 166/298 |
| 5,655,607 | A * | 8/1997 | Mellemstrand et al. | 166/386 |
| 5,964,240 | A * | 10/1999 | Granovski | 137/15.13 |
| 6,102,138 | A | 8/2000 | Fincher | |
| 6,155,360 | A * | 12/2000 | McLeod | 175/258 |
| 6,679,328 | B2 * | 1/2004 | Davis et al. | 166/298 |
| 7,021,404 | B2 * | 4/2006 | Fanuel et al. | 175/61 |
| 7,188,674 | B2 * | 3/2007 | McGavern et al. | 166/298 |
| 8,042,613 | B2 * | 10/2011 | Hallundbaek et al. | 166/297 |
| 8,499,834 | B2 * | 8/2013 | Guidry et al. | 166/298 |
| 2002/0144815 | A1 | 10/2002 | Van Drentham | |
| 2002/0162659 | A1 * | 11/2002 | Davis et al. | 166/298 |
| 2004/0045714 | A1 * | 3/2004 | McGavern et al. | 166/298 |
| 2007/0000696 | A1 | 1/2007 | Laflin | |
| 2007/0176424 | A1 | 8/2007 | Nobileau | |
| 2010/0101802 | A1 * | 4/2010 | Hallundbaek et al. | 166/376 |
| 2011/0240367 | A1 | 10/2011 | Guidry et al. | |
| 2012/0168228 | A1 | 7/2012 | Giroux | |
| 2012/0175845 | A1 | 7/2012 | Duan | |
| 2014/0060801 | A1 * | 3/2014 | Coleman et al. | 166/55.1 |

* cited by examiner

*Primary Examiner* — Jennifer H Gay
(74) *Attorney, Agent, or Firm* — Steve Rosenblatt

(57) ABSTRACT

A device is associated with a downhole tool to control the weight that can be set down on the tool while the tool is operating. A shroud is secured to the string that supports the tool with interior modular biasing components that for run in extend the tool past the shroud. Upon encountering a support for the tool, further set down weight compresses the biasing components for a predetermined stroke length delineated by the shroud landing on a support. If the tool is a mill, its operation takes place under the biasing force as the mill advances into the piece being cut or milled under a predetermined pressure. When the mill reaches full extension from the shroud the process can be repeated until the milling is complete. The shroud also centralizes the mill during milling.

20 Claims, 3 Drawing Sheets

PRELOAD AND CENTRALIZING DEVICE FOR MILLING SUBTERRANEAN BARRIER VALVES

FIELD OF THE INVENTION

The field of this invention is mill control as to set down weight and centralization during milling in subterranean locations and more specifically milling isolation valves such as ball and flapper type valves.

BACKGROUND OF THE INVENTION

One issue with milling at subterranean locations is to control the amount of weight on the mill. If too much weight is applied the cutting elements or the blade cutting structure can break off. This can slow the milling progress and force a trip out of the hole to redress the mill. Too little weight applied to the mill will slow the milling penetration rate. Some mills with delicate cutting structure or in certain situations where very hard material such as INCONEL is to be milled, need control on the weight applied during milling. One such mill is described in US Publication 2011/0240367.

Another issue when milling rounded shapes such as balls of isolation valve or curved flappers is the need to centralize the mill as it tries to penetrate the rounded surface. A centralizing device would be an advantage to keeping the mill on track and finishing the milling sooner.

Past designs have recognized the benefit of applying preload to such devices as threaded connections as illustrated in US Publication 2007/0176424. Other designs have employed a stack of Belleville washers to change the length of a telescoping joint associated with a downhole mud motor and its effective operation as discussed in US Publication 2007/0000696.

What is needed and provided by the present invention is a simply way to control how much force is applied to a mill when it is operating. The design is modular to allow variation in the applied force for milling. The mill will contact the material to be milled first. As weight is applied to the mill, the Bellville washer stacks will compress until the surrounding sleeve or shoe contacts the material to be milled. Once the surrounding sleeve or shoe makes contact, additional weight can be applied, but only the predetermined weight via the Bellvilles will be transferred to the mill. As the mill advances the Belleville washers maintain the predetermined force until mill movement allows them to fully relax.

Ideally enough Bellville washers in the modules should be stacks to allow milling to be completed with first milling assembly. If this is not possible, the milling assembly can be removed from the well and a shorter skirt or variation in Bellville washer stacks is installed in the next milling assembly to allow for further penetration into material to be milled. The use of the surrounding sleeve to land on the piece being cut and its placement near the cutting location allows it to act as a centralizer for the mill as the mill operates. Those skilled in the art will more readily appreciate other aspects of the invention from a review of the detailed description of the preferred embodiment and the associated drawings while recognizing that the full scope of the invention is to be found in the appended claims.

SUMMARY OF THE INVENTION

A device is associated with a downhole tool to control the weight that can be set down on the tool while the tool is operating. A shroud is secured to the string that supports the tool with interior modular biasing components that for run in extend the tool past the shroud. Upon encountering a support for the tool, further set down weight compresses the biasing components for a predetermined stroke length delineated by the shroud landing on a support. If the tool is a mill, its operation takes place under the biasing force as the mill advances into the piece being cut or milled under a predetermined pressure. When the mill reaches full extension from the shroud the process can be repeated until the milling is complete. The shroud also centralizes the mill during milling.

DETAILED DESCRIPTION OF THE PREFERRED EMBODIMENT

A BHA 10 is schematically illustrated above the items of interest to the present invention. A tool 12 which in the preferred embodiment is a mill that has passages 14 for fluid circulation to remove cuttings is shown in a lowermost position on the BHA 10. The mill 12 is illustratively shown as the invention can be employed with a variety of tools that may or may not actually do any cutting or milling. Accordingly, the mill 12 design is not a part of the present invention but is rather an illustration of the preferred use of the invention.

Figure 1:
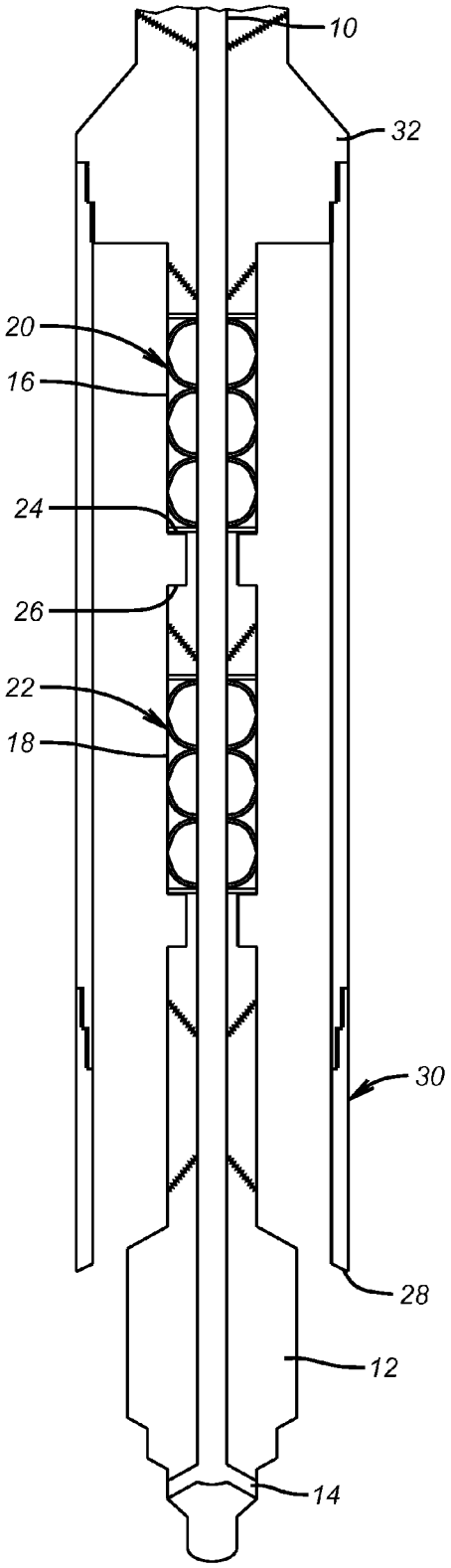
FIG. 1 is a schematic representation of the device in a milling application shown in the run in position.
Figure 2:
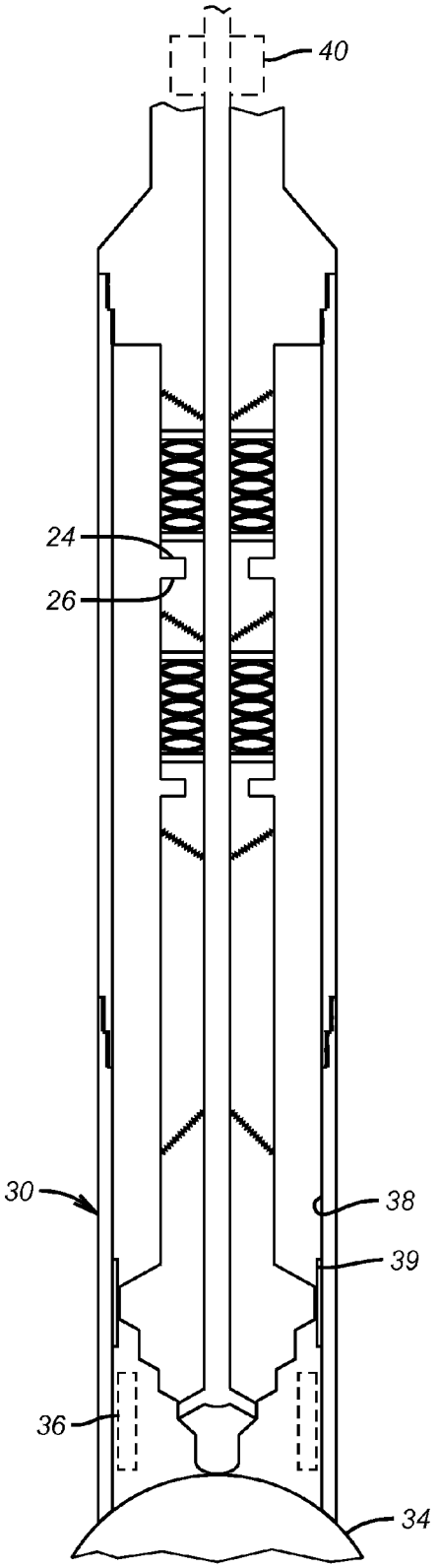
FIG. 2 is the view of FIG. 1 during milling.

The BHA contains modular telescoping assemblies 16 and 18. Although two are shown one or more than two can be used. Preferably, each module has a biasing component, such as 20 and 22, which are preferably stacks of Belleville washers although equivalents are also contemplated. Some other biasing equivalents can be a compressible gas or other types of springs. Belleville washer stacks are preferred for the constant applied force as the washers resume their relaxed position. The gap between surfaces 24 and 26 in the FIG. 1 position for run in illustrates the available stroke. For run in the surfaces 24 and 26 are at their maximum separation with the components 20 and 22 on their relaxed position. At this time the mill 12 also extends beyond the end 28 of shroud 30, as shown in FIG. 1. Shroud 30 has a top sub 32 supported by the BHA 10 in a manner that when mill 12 lands on an object to be milled such as a ball 34 of a formation isolation valve the forward progress of the mill 12 stops. However, the top sub can advance further in essence stroking telescoping components so that surface 24 for each modular assembly 16 or 18 moves closer to surface 26 but preferably without contact. The travel limit is defined by the lower end 28 coming into contact with the ball 34, as shown in FIG. 2. The same occurs at each module, with the number of modules used being determined by the preload targeted force needed on the mill 12 when milling the ball 34. The modules 16 or 18 do not need to have identical stacks of biasing components 20 or 22 with Belleville washer stacks being preferred because of the force generated with a fairly short stroke.

FIG. 2 also shows the shroud 30 in position around the mill 12 at the onset of milling. Since the ball 34 is rounded, the shroud 30 being disposed about the mill 12 and landed on the ball 34 with some weight set down on the shroud 34, the presence of the shroud 34 allows the shroud to centralize the mill 12 during the milling operation. Openings 36 are schematically illustrated in the shroud 34 to allow circulation flow with cuttings to be removed from the ball 34 that is being milled. These openings can be any shape and number as long as the structural integrity of the shroud 34 is not undermined. The interior surface 38 of the shroud or shoe 30 can be hardened in the vicinity of the mill 12 or have a hardened sleeve 39 applied or in the alternative the mill can have a peripheral ring of a soft material such as brass, all in an effort to reduce wear on the shoe 30 as it performs a centralizing function.

Figure 3:
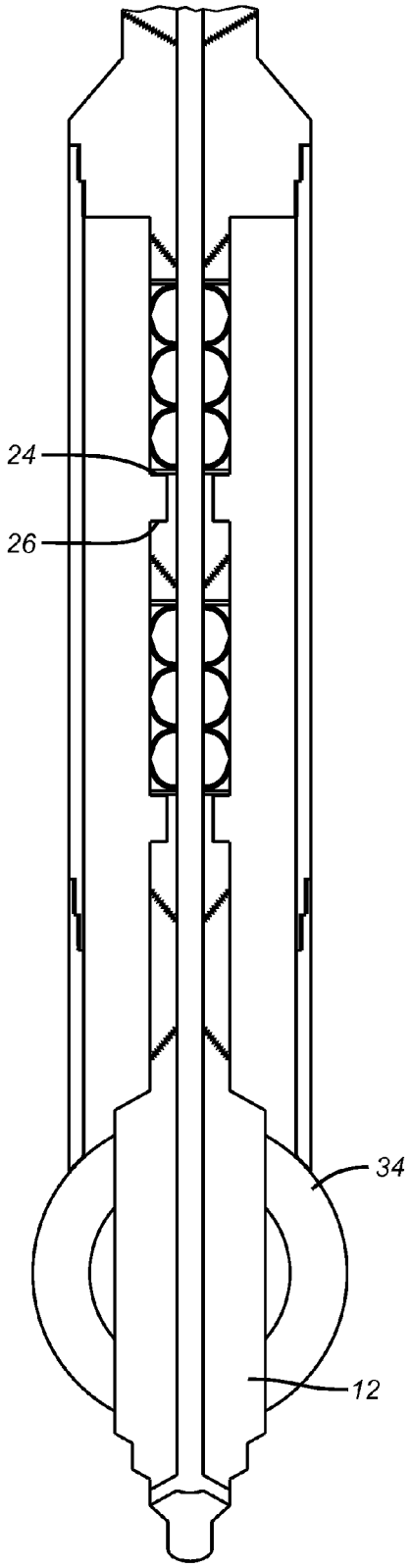
FIG. 3 is the view of FIG. 2 shown in the milling complete position through a ball in an isolation valve.

As the milling progresses, the mill 12 advances and the biasing assemblies 18 and 20 extend to maintain a force on the mill 12 as the surface 26 extends away from the now stationary surface 24 that is supported through the lower end 28 of the shoe 30 being landed on the ball 34 as the mill 12 cuts into it, as shown in FIG. 3.

FIG. 2 shows that in horizontal applications where setting down weight will not work to compress the assemblies 18 and 20 an optional hydraulic piston 40 that is schematically illustrated can be pressure actuated to accomplish the same task of energizing the assemblies 18 and 20 as was accomplished with setting down weight as shown in FIG. 1.

While milling tools are illustrated as preferred for an application of the invention, other tools are contemplated that need a predetermined preload force to operate in conjunction with axial or other types of movement.

The above description is illustrative of the preferred embodiment and many modifications may be made by those skilled in the art without departing from the invention whose scope is to be determined from the literal and equivalent scope of the claims below:

We claim:

1. An assembly for operation of a tool on an existing device at a subterranean location on a supporting string, comprising:

a tool supported on the string;

a shoe supported by the string and relatively axially movably mounted with respect to said tool;

a biasing assembly initially energized by relative axial movement between said tool and said shoe, said relative axial movement ends when said tool and said shoe are supported at separate locations on the existing device at the subterranean location to place a predetermined preload force on said tool against the existing device as said tool is axially operated against the device and in an axial direction relative to said shoe, said shoe remaining supported by the existing device.

2. The assembly of claim 1, wherein:

said shoe surrounds said tool and further comprises a lower end.

3. The assembly of claim 1, wherein:

said relative movement between said shoe and said tool is accomplished with setting down weight on the string with said tool in contact with the existing device.

4. The assembly of claim 1, further comprising:

a pressure operated piston associated with said shoe for initiating said relative movement between said shoe and said tool with said tool in contact with the existing device.

5. The assembly of claim 1, wherein:

said shoe centralizes said tool as said tool is operated.

6. The assembly of claim 1, wherein:

said biasing assembly applies a constant predetermined force on said tool as said tool advances axially with respect to said shoe.

7. An assembly for operation of a tool on an existing device at a subterranean location on a supporting string, comprising:

a tool supported on the string;

a shoe supported by the string and relatively axially movably mounted with respect to said tool;

a biasing assembly initially energized by relative axial movement between said tool and said shoe, said relative axial movement ends when said tool and said shoe are supported at separate locations on the existing device at the subterranean location to place a predetermined preload force on said tool against the existing device as said tool is axially operated against the device and in an axial direction relative to said shoe, said shoe remaining supported by the existing device;

said shoe surrounds said tool and further comprises a lower end;

said tool extends beyond said lower end until said tool contacts the existing device whereupon said lower end of said shoe advances toward the existing device.

8. The assembly of claim 7, wherein:

said advancing of said lower end is stopped when said lower end engages the existing device.

9. The assembly of claim 7, further comprising:

said advancing of said lower end of said shoe energizes said biasing assembly.

10. The assembly of claim 9, wherein:

said biasing assembly comprises at least one telescoping module with a biasing device inside.

11. The assembly of claim 10, wherein:

said biasing device comprises at least one spring or a compressible gas.

12. The assembly of claim 11, wherein:

said at least one spring comprises a stack of Belleville washers.

13. The assembly of claim 10, wherein:

said at least one module comprises a plurality of modules that deliver the same or different amounts of predetermined force for a predetermined amount of axial change in length of said telescoping modules.

14. The assembly of claim 10, wherein:

said telescoping assembly has a predetermined axial stroke length;

said lower end of said shoe engaging the existing device before said telescoping assembly has moved the predetermined axial stroke length.

15. The assembly of claim 7, wherein:

said tool comprises a mill whose operation removes at least a part of the existing device.

16. The assembly of claim 15, wherein:

said shoe further comprises at least one wall opening near said mill for fluid movement to remove cuttings.

17. The assembly of claim 16, wherein:

said mill engages said shoe when operating to keep said mill centralized.

18. The assembly of claim 17, wherein:

said shoe is hardened or comprises a hardened sleeve adjacent said mill or said mill has a peripheral wear ring for contact with said shoe as said mill operates.

19. The assembly of claim 15, wherein:

said biasing assembly applies a constant predetermined force on said mill as said mill advances axially with respect to said shoe.

20. The assembly of claim 19, wherein:

said biasing assembly comprises a plurality of stacked Belleville washers.

* * * * *